United States Patent [19]

von der Heyde et al.

[11] Patent Number: 5,006,049

[45] Date of Patent: Apr. 9, 1991

[54] PERISTALTIC PUMP

[75] Inventors: Richard von der Heyde, Breisach; Erich Becker, Bad Krozingen, both of Fed. Rep. of Germany

[73] Assignee: KNF Newberger GmbH, Frieburg-Munzingen, Fed. Rep. of Germany

[21] Appl. No.: 348,298

[22] Filed: May 5, 1989

[30] Foreign Application Priority Data

May 5, 1988 [DE] Fed. Rep. of Germany ..... 3815252

[51] Int. Cl.[5] ..... F04B 43/17; F04B 45/08

[52] U.S. Cl. ..... 417/476; 417/479

[58] Field of Search ..... 417/476, 479; 418/154, 418/45

[56] References Cited

U.S. PATENT DOCUMENTS

| | | | |
|---|---|---|---|
| 513,315 | 1/1894 | Funk | 417/476 |
| 664,507 | 12/1900 | Singer | 417/476 |
| 2,544,628 | 3/1951 | Copping | 417/476 X |
| 3,597,123 | 8/1971 | Lutz | 417/476 X |
| 3,687,580 | 8/1972 | Griffiths | 417/476 X |
| 4,332,534 | 6/1982 | Becker | 418/45 |
| 4,391,572 | 7/1983 | Lew | 417/479 X |

FOREIGN PATENT DOCUMENTS

| | | | |
|---|---|---|---|
| 82770 | 4/1957 | Denmark | 417/476 |
| 1330187 | 12/1963 | France | 417/476 |
| 341261 | 11/1959 | Switzerland | 417/476 |
| 180550 | 6/1922 | United Kingdom | 417/476 |
| 562409 | 6/1944 | United Kingdom | 417/476 |
| 583578 | 12/1946 | United Kingdom | 417/476 |
| 206603 | 10/1955 | United Kingdom | 417/476 |

*Primary Examiner*—Leonard E. Smith
*Assistant Examiner*—Eugene L. Szczecina, Jr.
*Attorney, Agent, or Firm*—Peter K. Kontler

[57] ABSTRACT

A peristaltic pump wherein an annular internal surface of the housing and a sleeve-like annular section of an elastically deformable diaphragm define an annular pumping chamber which communicates with the fluid-admitting inlet and with the fluid-discharging outlet of the housing. The diaphragm is provided with an extension which projects radially outwardly from the sleeve-like section and is partially anchored in a socket of the housing. A weakened portion of the extension between the anchored portion and the sleeve-like section is received in a compartment between the inlet and outlet of the housing and is provided with one or more empty or fluid-filled cavities, with one or more recesses, with one or more holes and/or other elasticity enhancing features to ensure that the resistance of the sleeve-like section to deformation will be uniform in each of its parts including that which is integral with the extension. This reduces the likelihood of vibration when the pump is in use, namely when a piston is caused to roll along the internal surface of the sleeve-like section to thereby draw fluid into the pumping chamber by way of the inlet and expel fluid from the chamber by way of the outlet. The sleeve-like section has an annular internal rib which extends with play into a circumferentially complete groove in the peripheral surface of the piston.

19 Claims, 3 Drawing Sheets

PERISTALTIC PUMP

BACKGROUND OF THE INVENTION

The invention relates to pumps in general, and more particularly to improvements in peristaltic pumps. Still more particularly, the invention relates to improvements in peristaltic pumps of the type wherein an annular diaphragm of elastically deformable material is installed in a housing and can be displaced against the internal surface of the housing to thereby cause a fluid to flow from an inlet to an outlet of the housing.

German Pat. No. 29 11 609 to Becker discloses a peristaltic diaphragm pump wherein a rotary piston is caused to roll along the internal surface of a sleeve-like section of the diaphragm to thereby urge successive increments of the sleeve-like section against the internal surface of the housing. The sleeve-like section and the internal surface of the housing define an annular pumping chamber which communicates (at least at times) with the inlet and the outlet. A radially outwardly projecting extension of the diaphragm is anchored in the housing between the inlet and the outlet. That portion of the sleeve-like section which is integral with the extension is stiffer than the remaining portion of the sleeve-like section. This causes the piston to induce vibrations, especially when it is caused to orbit in the sleeve-like section of the diaphragm at an elevated speed, i.e., when it travels along the extension at a high frequency. It could be said that the piston runs out of true because it is caused to depart from its prescribed path whenever it reaches the junction of the sleeve-like section with the extension.

German Pat. No. 28 53 916 to Becker discloses a modified peristaltic diaphragm pump wherein the junction between the sleeve-like section and the extension of the diaphragm is provided with a recess which is bounded by a concave surface and is intended to reduce the resistance of the junction to deformation by the piston which is caused to roll along the internal surface of the sleeve-like section. This contributes to complexity of the diaphragm but does not eliminate vibration, especially when the piston is caused to roll at a high speed, i.e., when it travels over the junction at a high or very high frequency.

It is necessary to ensure that the piston move successive increments of the sleeve-like section of the diaphragm into pronounced sealing engagement with the internal surface of the housing. This is particularly important if the pump is to convey a gaseous fluid because such mode of operation ensures that the pump is self priming. Thus, it is necessary to ensure that the peripheral surface of the rolling piston deform the adjacent portion of the sleeve-like section, i.e., such portion of the section must be deformed against the adjacent portion of internal surface of the housing. Furthermore, the thickness of the sleeve-like section must be selected with a view to ensure that the diaphragm can compensate for manufacturing and other tolerances. The result is that the sleeve-like section is squeezed between the piston and the housing. This is highly undesirable because squeezing or crushing of the diaphragm brings about pronounced fulling and prevents the pump from operating smoothly, quietly and without rapid destruction of the diaphragm. Moreover, the energy requirements of the means for rolling the piston along the internal surface of the sleeve-like section of the diaphragm are high. Attempts to provide the diaphragm with a relatively thin sleeve-like section have failed, mainly because this further shortens the life expectancy of the diaphragm.

OBJECTS OF THE INVENTION

An object of the invention is to provide a peristaltic diaphragm pump wherein the life expectancy of the diaphragm is much longer than in heretofore known pumps.

Another object of the invention is to provide a peristaltic pump which generates less noise and is less prone to vibration than conventional peristaltic pumps.

A further object of the invention is to provide the pump with a novel and improved housing, with a novel and improved piston and with a novel and improved diaphragm.

An additional object of the invention is to provide a peristaltic pump wherein the thickness of that section of the diaphragm which is acted upon by the piston can be reduced to a fraction of the thickness of corresponding sections of diaphragms in heretofore known pumps.

Still another object of the invention is to provide a novel and improved method of enhancing the elasticity of selected portions of the diaphragm.

A further object of the invention is reduce the energy requirements of the means for rolling the piston along the adjacent section of the diaphragm in the above outlined peristaltic pump.

SUMMARY OF THE INVENTION

One feature of the invention resides in the provision of a peristaltic pump which comprises a hollow housing having an annular internal surface (e.g., a surface composed of two frustoconical portions which are mirror images of each other and have maximum-diameter ends adjacent each other), a fluid-admitting inlet and a fluid-discharging outlet, and an elastically deformable diaphragm including an annular (preferably substantially sleeve-like) section which is disposed in the housing and defines with the internal surface an annular pumping chamber which communicates (at least at times) with the inlet and the outlet. The diaphragm further includes an extension which is anchored in the housing and projects from the section substantially radially outwardly between the inlet and the outlet of the housing. In accordance with a feature of the invention, the extension has at least one elasticity-enhancing weakened portion, and the pump further comprises a preferably rotary piston which is disposed in the section with radial play, and means (e.g., including an orbiting eccentric) for rolling the piston circumferentially of and along the section to thereby move successive increments of the section toward the internal surface of the housing whereby the sleeve-like section draws fluid into the pumping chamber by way of the inlet and expels fluid from the pumping chamber by way of the outlet. The section can be provided with one or more internal annular ribs.

The extension can include a second portion (e.g., a portion which is actually anchored in the housing) having a cross-section greater than the cross-section of the at least one weakened portion of the extension. The at least one weakened portion can be provided with at least one hole, preferably a hole extending in substantial parallelism with the axis of the section. Alternatively or in addition to one or more holes, the at least one weakened portion of the extension can be provided with at least one lateral recess. For example, that side of the extension which confronts the inlet can be provided with at least one first recess which is parallel to the axis of the section, and that side of the extension which confronts the outlet can be provided with at least one second lateral recess which is parallel to the axis of the section and is preferably offset with reference to the at least one first recess in the radial direction of the section. It is also possible to provide the at least one weakened portion with at least one sealed cavity for a gaseous or liquid fluid. The extension can have a substantially Z-shaped or S-shaped cross-sectional outline. The elasticity (especially as considered in the radial direction of the section) of the extension can match or approximate the elasticity of the section. This can be achieved by properly selecting the elasticity of the at least one weakened portion and/or by making at least a portion of the extension of a material having an elasticity greater than the elasticity of the material of the section.

The housing can be provided with an internal socket for a second portion of the extension and with an internal compartment which communicates with the socket, which is disposed between the inlet and the outlet, and which receives the at least one weakened portion with at least some play, especially as seen in the tangential direction of the adjacent portion of the section of the diaphragm, namely toward the inlet and the outlet of the housing.

The section has an internal surface which is preferably cylindrical in undeformed condition of such section.

The aforementioned annular internal rib of the sleeve-like section of the diaphragm can extend into a circumferentially complete groove in the peripheral surface of the piston. The elasticity (particularly radial elasticity) of the rib can be enhanced by providing it with at least one recess, cavity, groove, hole or channel. The distance of the bottom surface in the groove of the piston from the internal surface of the housing is preferably slightly less than the thickness of the rib of the section (as seen in the radial direction of the internal surface of the housing and the section).

The section preferably comprises at least one annular portion which is axially offset with reference to the rib, and the thickness of such portion of the section preferably equals or is less than the distance of the peripheral surface of the piston from the internal surface of the housing. Also, the thickness of the rib (as measured in the axial direction of the section) is preferably less (particularly slightly less) than the width of the groove in the peripheral surface of the piston.

The just discussed features of the grooved piston and of the rib and axially offset portion of the annular section constitute features for which protection is sought in combination with as well as independently of the features of the extension of the diaphragm and of the mode of installing such extension in the housing of the peristaltic pump.

The novel features which are considered as characteristic of the invention are set forth in particular in the appended claims. The improved peristaltic pump itself, however, both as to its construction and its mode of operation, together with additional features and advantages thereof, will be best understood upon perusal of the following detailed description of certain specific embodiments with reference to the accompanying drawing.

DESCRIPTION OF PREFERRED EMBODIMENTS

Figure 2:
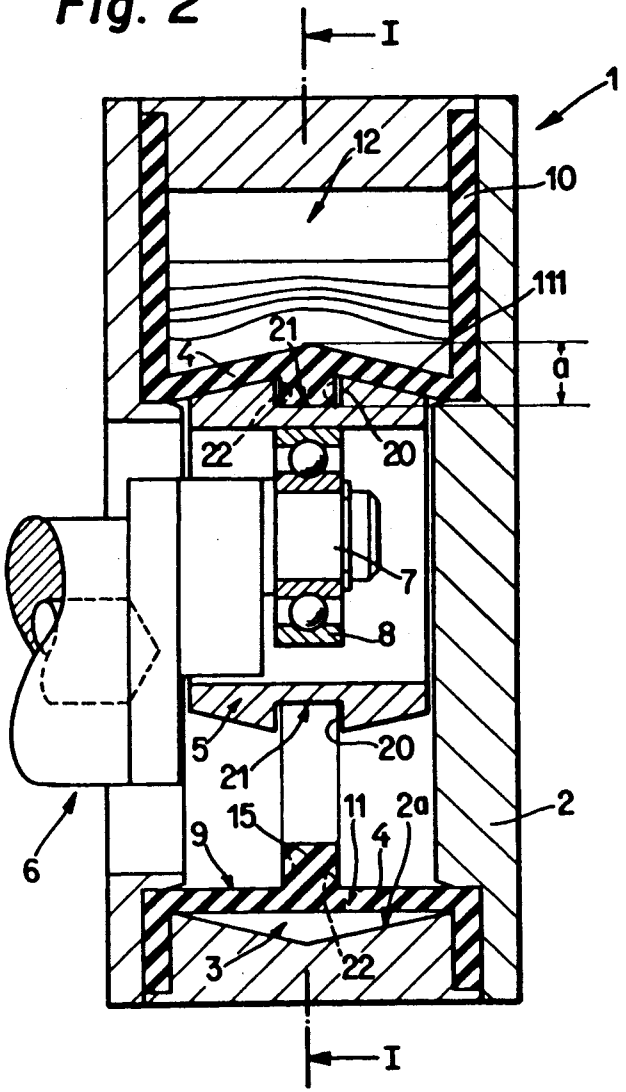
FIG. 2 is a sectional view substantially as seen in the direction of arrows from the line II—II of FIG. 1.
Figure 1:
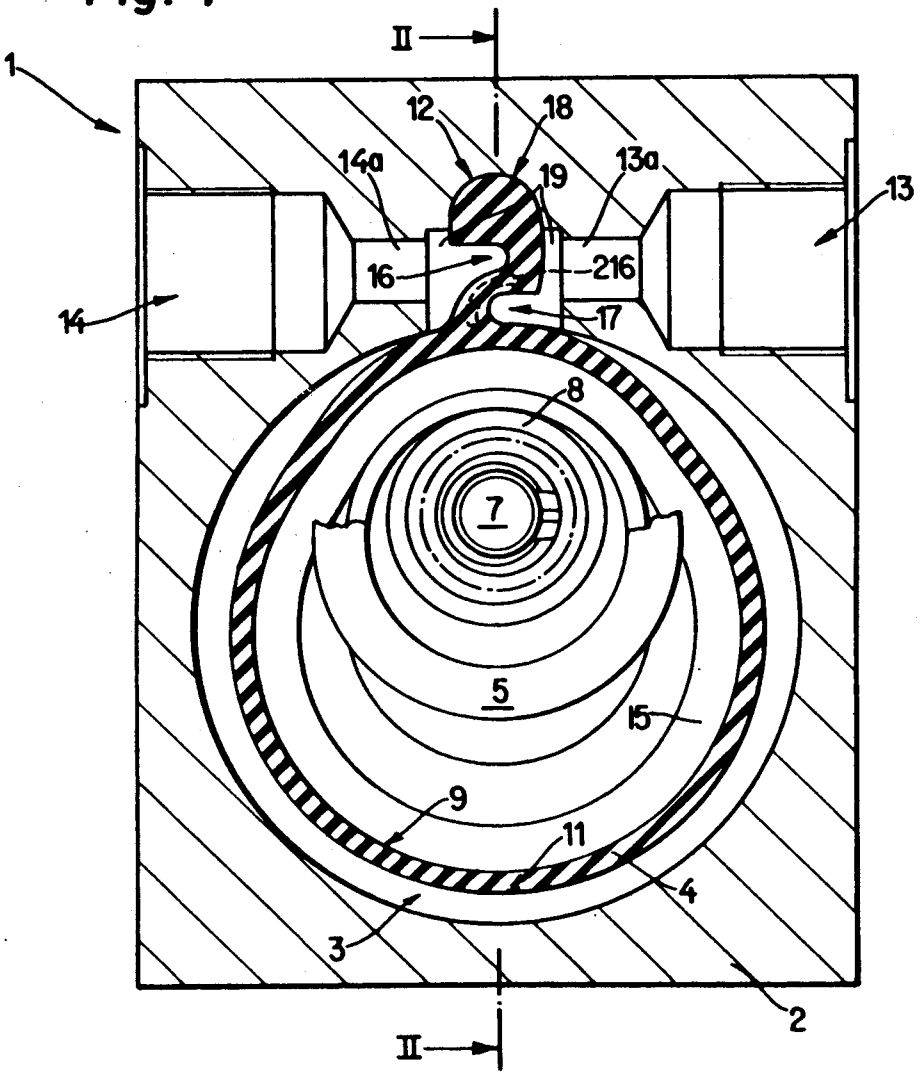
FIG. 1 is a sectional view of a peristaltic pump which embodies one form of the invention, the section being taken in the direction of arrows substantially as seen from the line I—I in FIG. 2.
Figure 5:
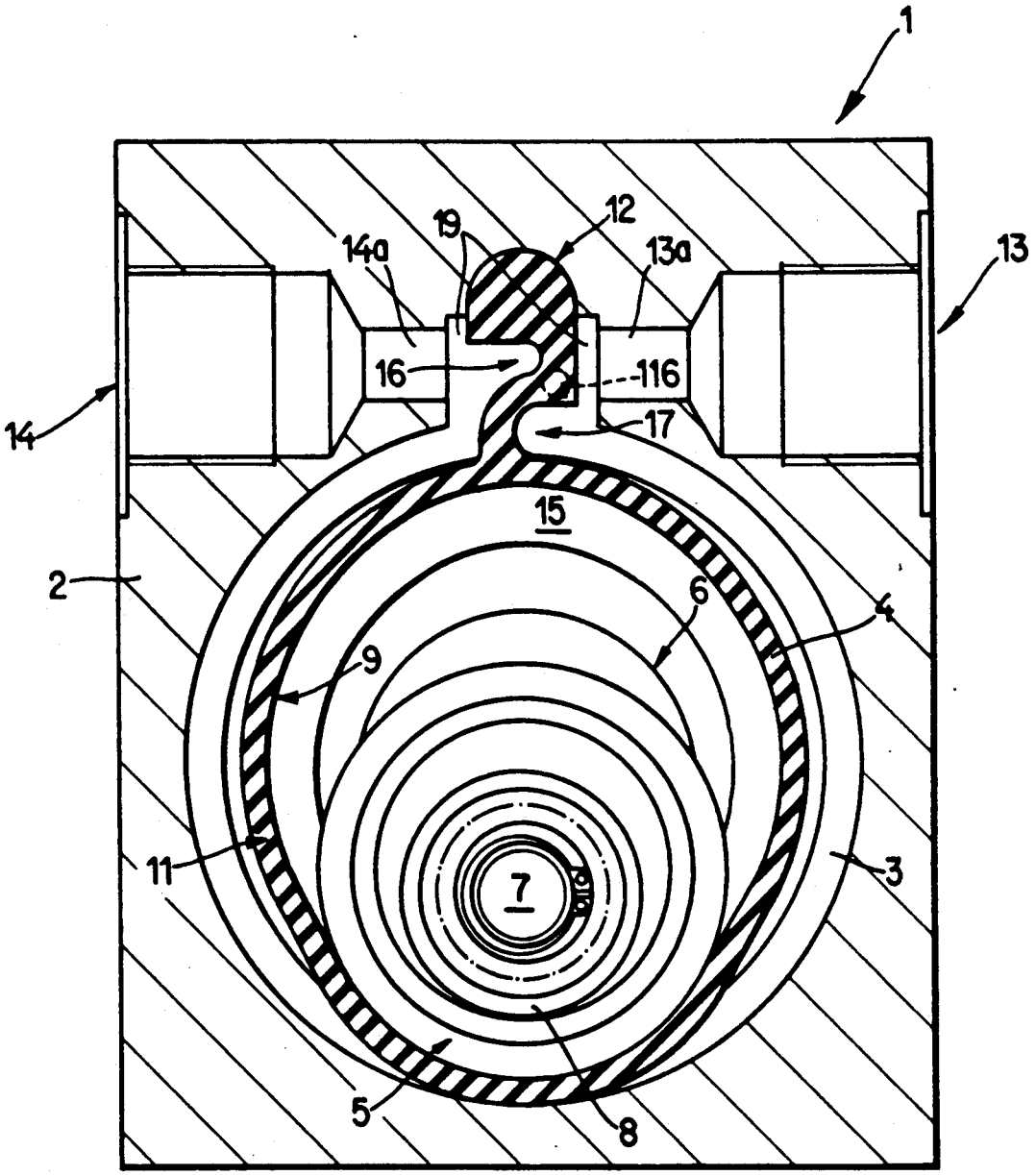
FIG. 5 is a sectional view corresponding to that of FIG. 1 but showing the piston in a different position with reference to the inlet and the outlet of the housing.

The peristaltic pump 1 which is shown in FIGS. 1, 2 and 5 comprises a hollow housing 2 defining a substantially cylindrical internal space for the annular (preferably sleeve-like) section 11 of an elastically deformable diaphragm 4. The section 11 and the surface 2*a* surrounding the internal space of the housing 2 define an annular pumping or working chamber 3 which communicates with a fluid-admitting inlet 13 and with a fluid-discharging outlet 14 of the housing. The pump 1 further comprises a rotary piston 5 which is received, with radial play, in the interior of the section 11 and is caused to roll along the internal surface 9 of the section by a moving means including a driven shaft 6 the axis of which coincides with the axis of the space in the housing 2, an eccentric stud 7 at the front end of the shaft 6, and an antifriction bearing 8 between the internal surface of the piston 5 and the stud 7. The piston 5 surrounds the bearing 8 with radial play.

When the pump 1 is in use, the moving means 6–8 causes the piston 5 to roll along the internal surface 9 of the section 11 whereby the pump draws fluid into the chamber 3 via inlet 13 and causes the fluid to leave the chamber 3 via outlet 14.

The diaphragm 4 further comprises two radially outwardly extending flanges 10 at opposite axial ends of the section 11, and an extension 12 which is integral with a portion of the section 11 and the radially outermost portion of which is snugly received in a complementary socket 18 of the housing 2. The extension 12 projects substantially radially of the section 11 and includes a weakened portion which is received with play (as seen in the tangential direction of the section 11) in a compartment 19 provided in the housing 2 between the socket 18 and the adjacent part of the section 11. The compartment 19 communicates with the adjacent smaller-diameter inner portion 13*a* of the inlet 13 as well as with the adjacent smaller-diameter inner portion 14*a* of the outlet 14. Direct flow of fluid from the portion 13*a* into the portion 14*a* is prevented by the extension 12. The portion 13*a* of the inlet 13 can communicate with the adjacent portion of the pumping chamber 3 by way of the respective part of the compartment 19, and the leftmost part of this compartment (as seen in FIGS. 1 and 5) can establish communication between the adjacent portion of the pumping chamber 3 and the smaller-diameter portion 14a of the outlet 14.

Figure 4:
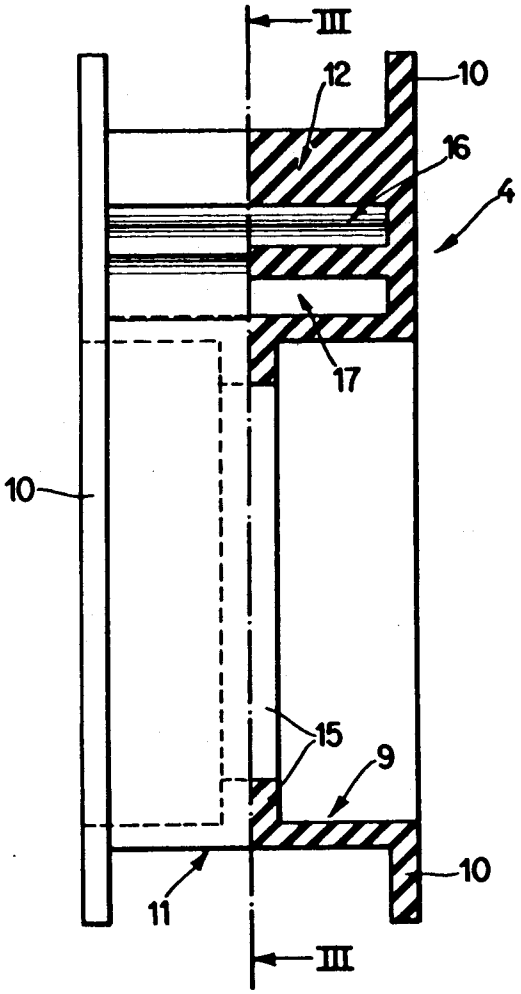
FIG. 4 is a partly end elevational and partly sectional view of the diaphragm, the section being taken in the direction of arrows as seen from the line IV—IV in FIG. 3.
Figure 3:
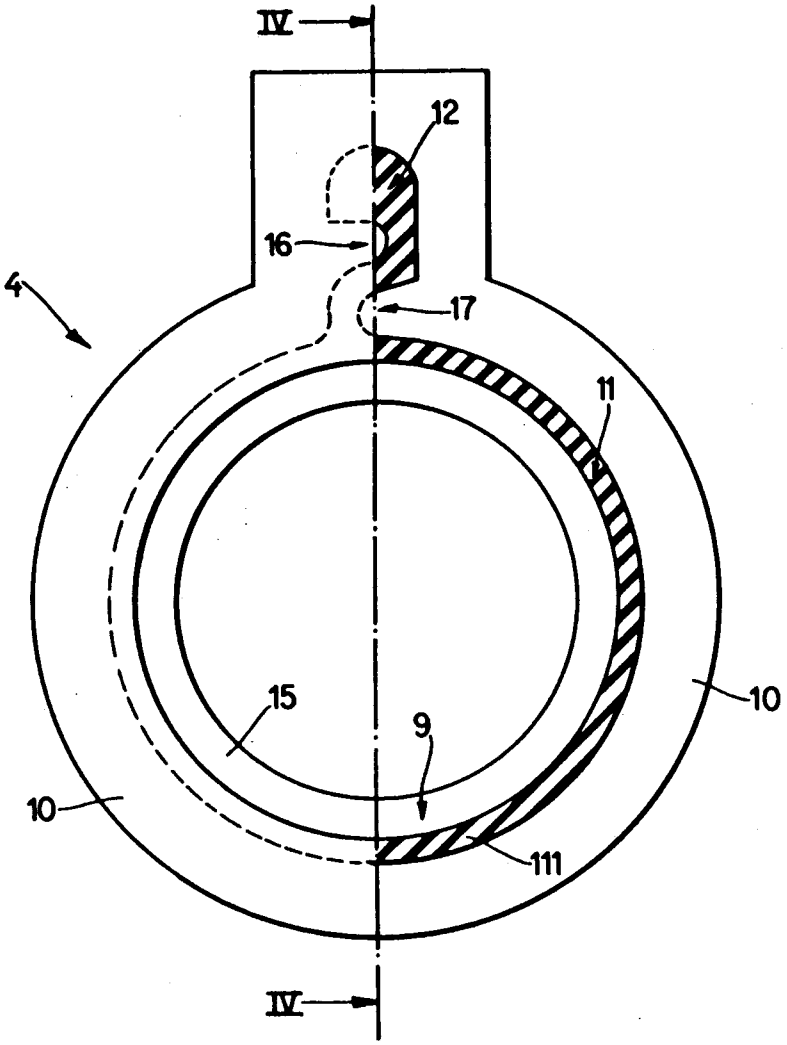
FIG. 3 is a partly front elevational and partly transverse sectional view of the diaphragm which is used in the pump of FIGS. 1 and 2, the section being taken in the direction of arrows as seen from the line III—III in FIG. 4.

The diaphragm 4 further comprises a circumferentially complete annular rib 15 which extends radially inwardly from the internal surface 9 of the section 11 and is flanked by two annular marginal portions 111 of the section 11. The just described and other features of the diaphragm 4 can be readily seen in FIGS. 3 and 4 which shows the diaphragm in undeformed condition prior to installation in the housing 2. The section 11 is preferably a true circular cylinder (or can closely resemble a circular cylinder) prior to deformation by the piston 5. The dimensions of the flanges 10 are or can be greatest in the region of the extension 12.

The orbiting and rolling piston 5 imparts to the section 11 of the diaphragm 4 the shape of a pear (see FIGS. 1 and 5) and the radially protruding lobe-like part of the section 11 (such lobe-like part is formed by the peripheral surface of the piston 5) travels along and reduces the volume of the adjacent portion of the pumping chamber 3 as it travels from the inlet 13 (to draw fluid into the chamber 3) toward and beyond the outlet 14, thereupon along the radially innermost portion of the extension 12, and again along the inlet 13.

The material of the section 11 is preferably selected in such a way that this section can be readily deformed by the piston 5 in the radial direction of the surface 2a around the internal space of the housing 2 but that its material offers a rather pronounced resistance to stretching in the circumferential direction. Such characteristics of the section 11 are enhanced by the rib 15. A portion of this rib extends into a circumferentially complete groove 20 in the peripheral surface of the piston 5.

In heretofore known peristaltic diaphragm pumps, the orbiting and rolling piston invariably encounters maximum resistance to deforming action upon the diaphragm during travel radially inwardly along the extension which holds the diaphragm against movement in the circumferential direction of the surface bounding the internal space of the housing. This generates shocks which, in turn, cause the entire pump to vibrate and induce the piston to roll along an endless path which is "out of true".

In accordance with a feature of the invention, that portion of the extension 12 which is disposed in the compartment 19 of the housing 2 is weakened in such a way that its elasticity is enhanced to thus prevent vibration of the pump 1 and uneven rolling of the piston 5 along the internal surface 9 of the section 11 and along the rib 15. The arrangement is such that the elasticity of the extension 12 is enhanced particularly in the radial direction, preferably to such an extent that the elasticity of the weakened portion in the compartment 19 equals or at least approximates the elasticity of the section 11.

One method of enhancing the elasticity of weakened portion of the extension 12 is to provide therein one or more holes or bores (note the hole 116 which is indicated in FIG. 5 by broken lines) which preferably extend in parallelism with the axis of the piston 5 and section 11. In addition, or in lieu of such undertaking, the elasticity of weakened portion of the extension 12 can be enhanced by imparting to the entire extension a substantially Z-shaped or S-shaped configuration (note FIGS. 1, 3 and 5). This can be achieved by provding that side of the extension 12 which confronts the adjacent open end of the inlet 13 with a first recess 17 and by providing the other side of the extension (i.e., the side confronting the outlet 14) with a second recess 16. The recesses 16, 17 are parallel to the axis of the section 11 and are offset relative to each other in the radial direction of the piston 5 and section 11. These recesses extend (but need not necessarily extend) all the way between the flanges 10 of the diaphragm 4. The cross-sectional area of that portion of the extension 12 which is anchored in the socket 18 is greater than the cross-sectional area of the weakened portion in the compartment 19. The configuration of the extension 12 and its weakened portion, coupled with the material of the section 11 and of the extension, can be selected in such a way that the elasticity of each and every portion of the diaphragm 4 which is acted upon by the piston 5 during each orbital movement of the piston along its endless path is the same. This invariably ensures that the operation of the pump 1 is quieter and smoother and that the pump does not vibrate as well as that the energy requirements of the motor which drives the shaft 6 are lower than in heretofore known peristaltic pumps with diaphragms of the type having a substantially sleeve-like section and an outwardly projecting extension which is anchored in the pump housing.

In addition to or in lieu of the hole 116 and/or recesses 16, 17, that portion of the extension 12 which is disposed in the compartment 19 to prevent direct flow of fluid from the inlet 13 to the outlet 14 can be provided with one or more empty or fluid-filled cavities 216. The confined fluid can be air or an other gas, or a hydraulic fluid such as water or oil.

The dimensions of the compartment 19 in the housing 2 are selected in such a way that this compartment provides ample room for lateral flow of the material of weakened portion of the extension 12 when the piston 5 assumes or is close to the position which is shown in FIG. 1, i.e., nearest to the inlet 13 and outlet 14. The smaller-diameter portions 13a, 14a of the inlet 13 and outlet 14 extend substantially tangentially of the section 11 of the diaphragm 4. As mentioned above, the compartment 19 can establish communication between the adjacent portions of the pumping chamber 3 and the inner ends of smaller-diameter portions 13a, 14a of the inlet 13 and outlet 14, respectively. The entire extension 12 is expelled from the cylindrical internal space of the housing 2 (i.e., such extension is then confined in the socket 18 and compartment 19) when the piston 5 approaches, assumes or is in the process of leaving the position of FIG. 1. On the other hand, the weakened portion of the extension 12 can extend well into the cylindrical internal space of the housing 2 when the piston 5 is remote from the compartment 19 (note FIG. 5). While the piston 5 causes (or can cause) the diaphragm 4 to seal the pumping chamber 3 from the inlet 13 and outlet 14 when the piston reaches the position of FIG. 1, the smaller-diameter portions 13a, 14a are free to communicate with the adjacent portions of the pumping chamber 3 when the piston 5 assumes or approaches the position of FIG. 5.

An advantage of the compartment 19 is that it constitutes an extension of the inlet 13 as well as an extension of the outlet 14. This is desirable and advantageous because the inlet 13 can be placed very close to the outlet 14; therefore, the section 11 of the diaphragm 4 and the internal surface 2a of the housing 2 can define a relatively long pumping chamber 3 (as seen in the circumferential direction of the section 11). This enhances the volumetric efficiency of the pump.

The weakened portion of the extension 12 in the compartment 19 of the pump housing 2 constitutes one feature of the improved pump. In accordance with another feature of the invention, the section 11 itself can be designed in such a way that it contributes to efficiency and other desirable features of the pump. Thus, and in order to ensure that the piston 5 will be capable of pressing successive increments of the section 11 against the adjacent portions of the internal surface 2a of the pump housing 2 with an optimum force (while simultaneously preventing excessive squeezing and potential squashing of the section 11), the minimum distance a of the bottom surface 21 in the circumferential groove 20 of the piston 5 from the internal surface 2a of the housing 2 is slightly less than the thickness of the rib 15 (i.e., the distance from the peripheral surface of the section 11 to the internal surface of the rib 15). This ensures that the bottom surface 21 in the groove 20 bears against the internal surface of the rib 15 with a force which ensures some deformation of the adjacent portion of the section 11 and an optimum engagement between the peripheral surface of the section 11 and the surface 2a of the housing 2. Moreover, such selection of the minimum distance a renders it possible to reduce the thickness of the two annular marginal portions 111 which form part of the section 11 and flank the rib 15, and to reduce the pressure upon the portions 111 while the piston 5 orbits along its endless path adjacent the internal surface of the section 11. A similar result, or the same result, can be achieved by selecting the distance of the major part of the peripheral surface of the piston 5 from the internal surface 2a in such a way that the marginal portions 111 of the section 11 are not subjected to pronounced or excessive radial compressive stresses when the pump 1 is in actual use.

It will be seen that the transmission of forces from the piston 5 to the section 11 takes place primarily in the relatively narrow region of the rib 15, i.e., by way of the rib. This relieves the marginal portions 111, i.e., the fulling action upon the marginal portions 111 is not pronounced. This, in turn, renders it possible to use a relatively thin section 11 and to thus reduce the energy requirements of the motor which drives the moving means 6–8 for the piston 5.

In order to reduce excessive radial stressing of the rib 15 (i.e., of that part of the section 11 which is subjected to greatest compressive and deforming stresses), the configuration of the piston 5 and rib 15 is selected in such a way that the rib is free to yield in response to stresses of a given magnitude. This is achieved in that the width of the groove 20 in the peripheral surface of the piston 5 is greater than the thickness of the rib 15 (in the axial direction of the section 11). Therefore, that portion of the rib 15 which extends into the groove 20 can expand in the axial direction of the section 11. The difference between the width of the groove 21 and the thickness of the rib 15 can be seen in the upper portion of FIG. 2.

In addition to or instead of the just discussed selection of the width of the groove 20, the section 11 can be provided with other features which enable the rib 15 to yield when the radial stressing action of the piston 5 reaches a maximum permissible value. FIG. 2 shows, by way of example, that at least one radially extending lateral surface of the rib 15 can be provided with a circumferentially complete or interrupted recess 22 in the form of a channel which can receive some material of the rib when the internal surface of the rib is acted upon by the bottom surface 21 in the groove 20 of the piston 5. The recess or recesses 22 enhance the radial yieldability of the rib 15 and contribute to longer useful life of the diaphragm 4 while ensuring a highly satisfactory engagement between the external surface of the section 11 and the internal surface 2a of the housing 2. The width of the groove 20 need not exceed the thickness of the rib 15 if the latter is provided with one or more recesses 22 which are capable of permitting required lateral deformation of the rib under the action of the bottom surface 21 in the groove 20 of the piston 5.

It has been found that the just discussed undertakings to enhance the radial elasticity of the rib 15 and/or to enhance the radial elasticity of the extension 12 not only prolong the useful life of the diaphragm 4 but also enable the improved pump 1 to convey not only liquids but also low-viscosity fluids (such as air) with a high degree of reliability. In addition, and as already mentioned above, the pump can operate with a relatively thin diaphragm which is readily deformable so that the energy requirements of the motor for the moving means 6–8 are reduced accordingly. Still further, the generation of heat is less pronounced than when a peristaltic pump is required to use a relatively thick and rather hard-to-deform diaphragm.

Another important advantage of the improved pump and its diaphragm is that the diaphragm can be mass-produced at a reasonable cost. The aforediscussed cylindrical shape of the section 11 (in undeformed condition of the diaphragm) is one of the factors which contribute to lower cost of the diaphragm. A relatively thin-walled diaphragm exhibits the additional advantage that it contributes to quieter and smoother operation of the pump. Still further, the aforediscussed features of the extension 12 and/or section 11 and its rib 15 render it possible to compensate for manufacturing and assembling tolerances. For example, the rib 15 can compensate for manufacturing tolerances which result in increased thickness of the section 11 and/or its rib 15. This is achieved without unduly stressing the other portion or portions (such as the extension 12) of the diaphragm.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. A peristaltic pump comprising a hollow housing having an annular internal surface, a fluid-admitting inlet and a fluid-discharging outlet; an elastically deformable diaphragm including an annular section disposed in said housing and defining with said internal surface an annular pumping chamber which communicates with said inlet and said outlet, said diaphragm further including an extension anchored in said housing and extending from said section substantially radially outwardly between said inlet and said outlet, said extension having at least one elastically-enhancing weakened portion, a first side confronting said inlet and a second side confronting said outlet, said at least one weakened portion having at least one first recess in said first side and at least one second recess in said second side, said at least one first recess being offset with reference to said at least one second recess in the radial direction of said section; a rotary piston disposed in said section with radial play; and means for rolling said piston circumferentially of and along said section to thereby move successive increments of said second toward said internal surface so that the section draws fluid into said chamber by way of said inlet and expels fluid from said chamber by way of said outlet.

2. The pump of claim 1, wherein said section of said diaphragm has an internal annular rib.

3. The pump of claim 1, wherein said extension has a second portion having a cross-sectional area greater than the cross-sectional area of said at least one weakened portion.

4. The pump of claim 1, wherein said at least one weakened portion has at least one hole extending in substantial parallelism with the axis of said piston.

5. The pump of claim 1, wherein at least one recess extends in substantial parallelism with the axis of said piston.

6. The pump of claim 1, wherein said extension has a substantially S- shaped or Z-shaped cross sectional outline in a plane which is substantially normal to the axis of said piston.

7. The pump of claim 1, wherein said section has a first elasticity, said extension having a second elasticity which approximates or matches said first elasticity.

8. The pump of claim 1, wherein said section has a first radial elasticity and said extension has a second radial elasticity which matches or approximates said first elasticity.

9. The pump of claim 1, wherein said extension has at least one cavity.

10. The pump of claim 1, wherein said section consists of a material having a first elasticity, said extension consisting at least in part of a material having an elasticity greater than said first elasticity.

11. The pump of claim 1, wherein said extension has at least one fluid-filled cavity.

12. The pump of claim 11, wherein the fluid in said at least one cavity is a gas.

13. The pump of claim 11, wherein the fluid in said at least one cavity is a liquid.

14. The pump of claim 1, wherein said housing has a socket and said extension has a second portion in said socket, said housing further having a compartment adjacent said socket and communicating with said inlet and said outlet, said at least one weakened portion of said diaphragm being disposed in said compartment between said inlet and said outlet.

15. The pump of claim 14, wherein said section is integral with said at least one weakened portion, said at least one weakened portion being received in said compartment with at least some play in directions toward said inlet and said outlet.

16. The pump of claim 15, wherein said compartment extends beyond said at least one weakened portion substantially tangentially of said section.

17. The pump of claim 1, wherein said section has a substantially cylindrical internal surface in undeformed condition thereof, said piston being arranged to roll along the internal surface of said section.

18. The pump of claim 1, wherein said section has an annular internal rib and said piston has a peripheral surface with a circumferentially complete groove for a portion of said rib.

19. The pump of claim 18, wherein said annular section has means for enhancing the elasticity of said rib.

* * * * *

UNITED STATES PATENT AND TRADEMARK OFFICE

CERTIFICATE OF CORRECTION

PATENT NO. : 5,006,049

DATED : April 9, 1991

INVENTOR(S) : Richard von der Heyde, et al

It is certified that error appears in the above-identified patent and that said Letters Patent is hereby corrected as shown below:

On the title page, Item [73]: "Newberger" should read --Neuberger--.

Col. 7, line 11 - "a" should read --a--.
Col. 7, line 22 - "a" should read --a--.
Col. 8, line 62 - "elastically-" should read --elasticity- --.
Col. 9, line 4 - "second" should read --section--.

Signed and Sealed this

Twenty-first Day of September, 1993

Bruce Lehman

*Attest:*

BRUCE LEHMAN

*Attesting Officer*

*Commissioner of Patents and Trademarks*